US005103726A

United States Patent [19]

Wieland

[11] Patent Number: 5,103,726

[45] Date of Patent: Apr. 14, 1992

[54] INKING SYSTEM ROLLER DRIVE

[75] Inventor: Erich G. Wieland, Mittlerer Dallenbergweg, Fed. Rep. of Germany

[73] Assignee: Koenig & Bauer AG, Fed. Rep. of Germany

[21] Appl. No.: 686,431

[22] Filed: Apr. 17, 1991

[30] Foreign Application Priority Data

Apr. 26, 1990 [DE] Fed. Rep. of Germany ..... 4013416

[51] Int. Cl.[5] ..... B41F 31/14; B41L 27/32

[52] U.S. Cl. ..... 101/349

[58] Field of Search ..... 101/348, 349, 350, 351, 101/352, DIG. 38, 207-210

[56] References Cited

U.S. PATENT DOCUMENTS 1,607,931 11/1926 White ..... 101/349 X
2,506,778 5/1950 Crafts et al. ..... 101/DIG. 38
3,994,222 11/1976 Pullen .

FOREIGN PATENT DOCUMENTS 3628787 4/1987 Fed. Rep. of Germany .

*Primary Examiner*—J. Reed Fisher
*Attorney, Agent, or Firm*—Jones, Tullar & Cooper

[57] ABSTRACT

An axially shiftable and rotatably driven oscillatory roller is positively coupled to a drive assembly through a universal joint and an encircling sleeve. The oscillatory roller can be moved to shift its axis of rotation with respect to the axis of rotation of its gear drive.

6 Claims, 3 Drawing Sheets

INKING SYSTEM ROLLER DRIVE

FIELD OF THE INVENTION

The present invention is directed generally to an inking system roller drive. More particularly, the present invention is directed to a roller drive for an inking or dampening unit roller of a rotary printing press. Most specifically, the present invention is directed to a direct roller drive for effecting both rotary and oscillatory motion of an, inking or dampening unit roller of a rotary printing press. The roller is rotatably driven through a universal type joint and is concurrently able to be shifted axially through an annular sleeve that surrounds the universal joint. A space is provided between the universal joint and its overlying sleeve so that the roller can also be moved away from the surface of a rotary plate cylinder in conjunction with spaced ink forme rollers that engage the oscillatory roller.

DESCRIPTION OF THE PRIOR ART

Axially shiftable oscillatory rollers are generally known in the art and are often used in inking units or dampening fluid applicators. These oscillatory rollers are typically used to achieve uniformity of a coating that is applied to or by one or more ink forme rollers or dampening fluid applicator rollers with which the oscillatory roller is in surface contact.

An axially movable oscillatory roller, which is in cooperative contact with two ink forme rollers, is shown in German published unexamined patent application No. 3628787. In this device, the oscillatory roller, as well as the ink forme rollers, can be moved into or out of cooperation with a plate cylinder. In this prior art device, the oscillatory roller is not provided with a positive drive means. This results in the oscillatory roller being driven only through frictional contact with the ink forme rollers. The use of such a frictional drive between the oscillatory roller and the ink forme rollers results in a certain amount of wheel slip. This wheel slip is unavoidable and increases in a dampening unit. The frictional forces between the oscillatory roller and the dampening fluid rollers decrease as the coefficient of friction decreases with an increasing percentage of dampening fluid particles. In arrangements in which several rollers are each driven by frictional contact with a previous frictionally driven roller, the subsequent roller or rollers experience a marked increase in slippage. This increasing slippage can lead to inking problems, such as streaking or dot enlargement on the printing plates.

In U.S. Pat. No. 3,994,222 there is shown the use of an oscillatory drive for ink forme rollers of a rotary press. It is, however, not possible in this structure to also install the o oscillatory rollers so that they are able to be swivelled or moved off the surface of the plate cylinder. When the oscillatory roller is in cooperation with one or more ink forme rollers which must periodically be moved off the surface of the plate cylinder, for example, in the case of a plate change, then the oscillatory roller itself must be movable away from the plate cylinder with the ink forme rollers or the damping system rollers.

The prior art devices have not provided an oscillatory and rotary roller which is positively driven yet which can be oscillated and which further can be moved off the plate cylinder. The inking system roller drive of the present invention, as will be discussed shortly, provides such a device and is a significant improvement over the prior art devices.

SUMMARY OF THE INVENTION

It is an object of the present invention to provide an inking system roller drive.

Another object of the present invention is to provide a roller drive for an inking or dampening unit roller of a rotary printing press.

A further object of the present invention is to provide a positive oscillatory and rotary drive for an inking or dampening system roller.

Still another object of the present invention is to provide a positive oscillatory and rotary drive for a roller which is movable away from a plate cylinder of a rotary press.

Even a further object of the present invention is to provide an oscillatory and rotary ink system roller drive that uses a universal joint.

As will be discussed in detail in the description of the preferred embodiments, which is set forth subsequently, the inking system roller drive in accordance with the present invention utilizes a universal joint in conjunction with an axially shiftable sleeve that carries a ring gear on one end thereof to effect a positive oscillatory and rotary drive of an ink roller or dampening fluid roller while at the same time allowing the roller to be moved away from the surface of a plate cylinder with which it cooperates. The universal joint is supported within the axially shiftable sleeve and is spaced therefrom so that the universal joint can move with respect to the sleeve as the roller is moved off the plate cylinder.

The inking system drive roller of the present invention uses positive toothed drive gears to effect the rotation of the oscillatory roller. Oscillation of the roller is accomplished by a pivot arm or the like. The drive gears and pivot arm are mounted outside of the side frames of the printing press so that they can easily be greased and otherwise serviced. They do not come into contact with the printing ink. The oscillatory roller is subjected only to torque forces caused by its contact with the ink forme rollers. Any other forces in the X or Y direction which may result from the positive drive of the oscillatory roller, are taken up by the side frames of the press assembly. This isolation of the oscillatory roller from these driving forces ensures that different o contact forces between the oscillatory roller and the ink forme rollers along the lengths of these rollers is avoided.

The inking system roller drive in accordance with the present invention does not rely on frictional forces between it and the ink forme rollers or dampening system rollers which it contacts for its rotational drive. The drive of the oscillatory roller is positive and will not vary with an increase in dampening fluid particles. The inking system roller drive of the present invention also allows the oscillatory roller to be moved off the surface of the plate cylinder. Thus the inking system roller drive of the present invention overcomes the limitations of the prior art devices and is a substantial advance in the art.

BRIEF DESCRIPTION OF THE DRAWINGS

While the novel features of the inking system roller drive in accordance with the present invention are set forth with particularity in the appended claims, a full and complete understanding of the invention may be had by referring to the detailed description of the preferred embodiment, as is presented subsequently, and as illustrated in the accompanying drawings, in which:

DETAILED DESCRIPTION OF PREFERRED EMBODIMENTS

Figure 1:
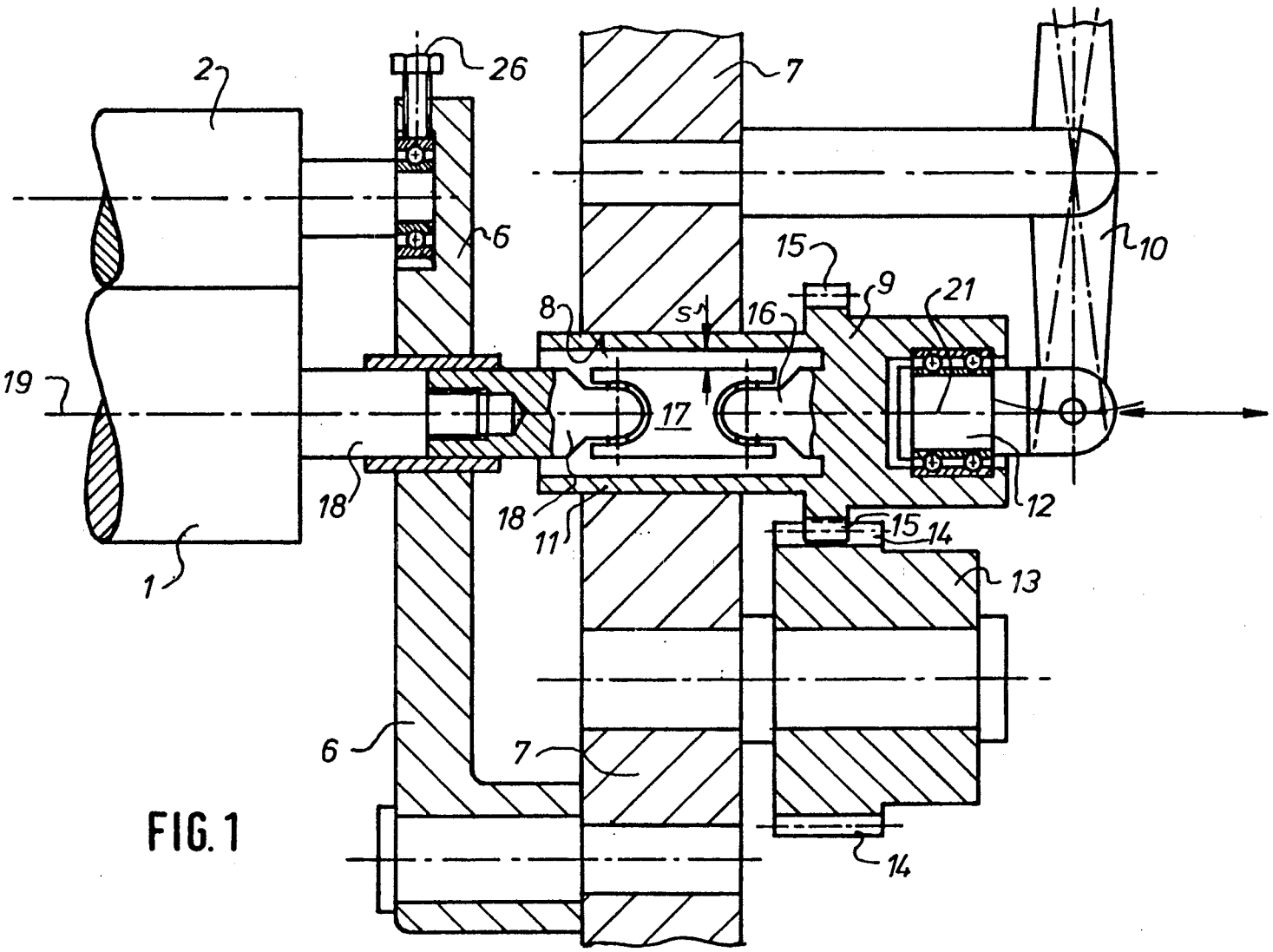
FIG. 1 is a side elevation view, partly in section, of the inking system roller drive of the present invention.

Referring initially to FIG. 1, the present invention will be discussed in use with an oscillatory roller 1 which is in surface contact with two spaced ink forme rollers 2 and 3, as may also be seen in FIGS. 2 and 3. These ink forme rollers 2 and 3 cooperate with a plate cylinder 4 on whose surface they typically roll. It will be understood that the oscillatory roller while being depicted here with ink forme rollers 2 and 3, could also be used with a dampening system which would supply dampening fluid to the plate cylinder 4.

Figure 2:
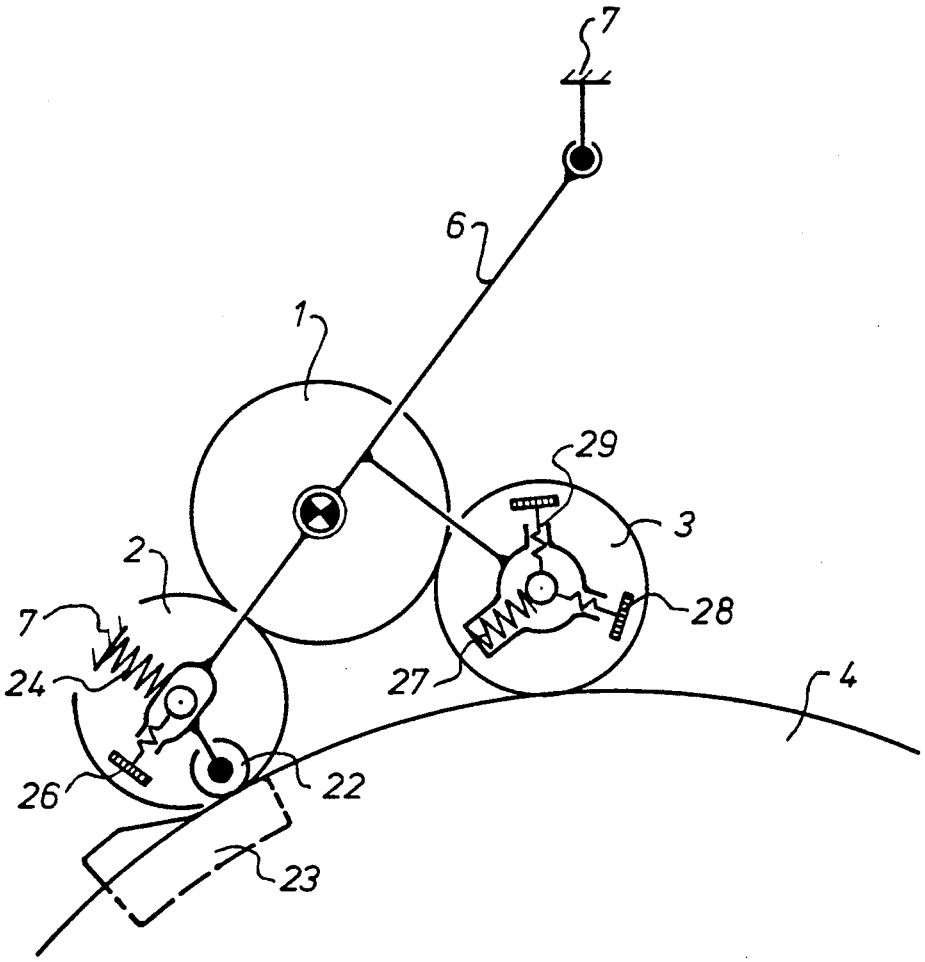
FIG. 2 is a schematic end view of a first preferred embodiment of ink forme rollers and the inking system roller drive of the present invention.

As may be seen in FIGS. 1 and 2, the two spaced ink forme rollers 2 and 3, as well as the oscillatory roller 1, are all rotatably supported in spaced pivoting frames 6 that are positioned on either side of a rotary press assembly which is not specifically shown. Each pivoting frame 6 is pivotably secured to one side frame 7 of the rotary press. For simplicity only one such pivoting frame 6 and its associated side frame 7 is shown in FIG. 1.

A drive gear ring 9 is formed on one end of an elongated bushing or sleeve 11. This sleeve 11 is supported in a bore hole 8 in the side frame 7 and can both rotate in bore hole 8 as well as move laterally with respect to the side frame 7. Drive gear ring 9 is formed on sleeve 11 exteriorly of side frame 7. A pivoting bearing 12 is carried in an annular recess in the outer end of sleeve 11 and is connected to a first end of a pivot drive 10. This pivot drive 10 is connected at a second end (not shown) to a suitable oscillatory drive, such as a crank or cam gear, or a pneumatic or hydraulic drive. This allows pivot drive 10 to effect an oscillatory shifting of the sleeve 11 in the bore hole 8 in the side frame 7. As sleeve 11 is moved in an oscillatory manner, so is drive gear ring 9.

A drive gear 13 is supported for rotation on the outer surface of side frame 7. This drive gear 13 is driven by the press drive in a manner not shown. The teeth 14 of drive gear 13 mesh with, and drive, teeth 15 of the drive gear ring 9. As may be seen in FIG. 1, the teeth 14 of the gear 13 are quite wide in comparison with the teeth 15 of the drive gear ring 9. This will allow the gear ring 9 to slide axially with respect to the gear 13 while allowing the gear teeth 14 and 15 to remain in meshing contact. Thus as bushing 11 is oscillated by pivot drive 10, the gear ring 9 will continue to be driven by the gear 13.

Bushing 11 encircles a coaxially extending drive shaft 16 which is connected at a first end to the drive gear ring 9 and to the bushing 11. The drive shaft 16 is joined at its second end to a first joint of a double joint universal joint coupling 17. A second joint of the double joint universal joint coupling 17 is connected with the first end of a roller drive shaft 18 of the oscillatory roller 1. Rotation of the gear ring 9 is carried through the drive shaft 16, the universal joint 17, and the roller drive shaft 18 to the oscillatory roller 1.

It will be understood that it would be possible to position the gear ring 9 in a manner such that it would be rotatable but not axially shiftable. In such a structure, the drive shaft 16 would be shiftable in relation to the bushing or sleeve 11 and the gear ring 9. The drive shaft 16 would be joined to the gear ring 9 and bushing 11 in a non-rotatable manner such as a splined shaft, a toothed shaft, or a polygonal connection.

The above discussed structure allows the oscillatory roller 1 to both rotate and oscillate in the pivoting frame 6 with regard to the press side frame 7. As will now be discussed with reference to FIGS. 2 and 3, the pivoting frame 6 allows the oscillatory roller 1 together with the ink forme rollers 2 and 3 to be moved away from the surface of the plate cylinder 4 which is itself rotatably secured between the spaced press side frames 7.

In the first embodiment which is depicted somewhat schematically in FIG. 2, the pivoting frame 6 carries a rotatable control roller 22 at a free end. This control roller 22 is positioned to ride on the outer surface of the plate cylinder 4 and will contact a cam surface 23 which can be elevated With respect to the surface of the plate cylinder 4. A compression spring 24 extends between the pivoting frame 6 and the press side frame 7 and biases the control roller 22 into contact with the surface of the plate cylinder 4.

The first ink forme roller 2 is shiftably carried in an aperture in the pivot frame 6 and is adjustably positionable in the pivot frame by an adjusting screw 26. This allows the wheel base between the oscillatory roller 1 and the first ink roller 2 to be adjusted. The second ink forme roller 3 is secured to the pivot frame 6 by means of a compression spring 27 and two adjusting screws 28 and 29. This compression spring 27 and the two adjusting screws 28 and 29 form a triangular support for the second ink forme roller 3. Adjustment of the second ink forme roller 3 with respect to the oscillatory roller 1 and the plate cylinder 4 is thus easily accomplished.

As the control roller 22 rides on the surface of the plate cylinder 4, it will contact and ride up on the cam 23. This deflects the pivot frame 6 against the force of the compression spring 24. The first and second ink forme rollers 2 and 3, together with the oscillatory roller I, are thereby moved away from the surface of the plate cylinder 4. This moves the two ink forme rollers 2 and 3, together with the oscillatory roller with respect to the stationary side frames 7. This relative movement between the oscillatory roller 1 and the fixed side frame 7 is facilitated by the universal joint 17. Referring again to FIG. 1, it may be seen that the sleeve or bushing 11 which encircles the universal joint 17 is spaced therefrom by a gap S. The gap S is of sufficient size to allow the oscillatory roller 1 to move off the plate cylinder and with respect to the fixed side frames 7.

Figure 3:
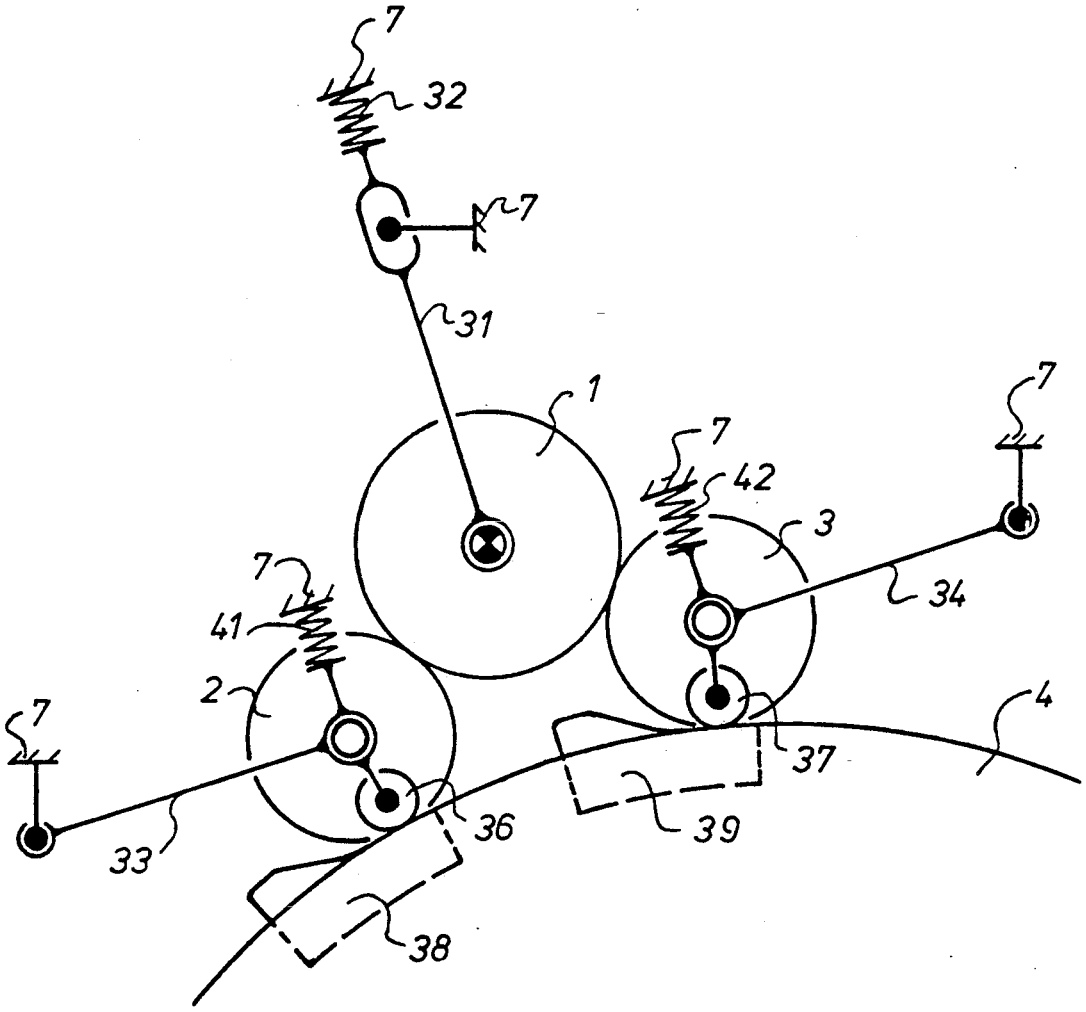
FIG. 3 is a schematic end view of a second preferred embodiment of ink forme rollers and the inking system roller drive of the present invention.

Turning now to FIG. 3, in the second preferred embodiment of the support for the ink forme rollers 2 and 3, the oscillatory roller 1 is rotatably supported at a first end of a bearing lever 31 which is generally the equivalent of the pivot frame 6 of the first embodiment. The bearing lever is shiftably supported by the o press side frames 7 and can move vertically with respect to an axis of rotation of the plate cylinder 4. This vertical movement of bearing lever 31 is opposed by a compression spring 32 which is attached to the side frame 7. Each of the first and second ink forme rollers 2 and 3 of this second preferred embodiment is supported at a first end of a respective bearing lever 33 or 34. Second ends of these ink forme roller bearing levers 33 and 34 are supported for movement by the side frames 7. Each of these bearing levers 33 and 34 carries a control roller 36 or 37, respectively. These control rollers are rotatably supported on the bearing levers 33 and 34 and each can engage a cooperating cam 38 or 39, respectively, which is positionable on the outer surface of the plate cylinder. Each of the bearing levers 33 and 34 further has a compression spring 41 or 42, respectively which engages the side frame 7 and which biases the respective control roller 36 or 37 against the surface of the plate cylinder 4.

As was the case with the first preferred embodiment, the control rollers 36 and 37 can run up onto their respective cams 38 and 39 to thereby elevate the ink forme rollers 2 and 3 off the surface of the plate cylinder 4. This movement of the ink forme rollers is opposed by their compression springs 41 and 42. The movement of the ink forme rollers 2 and 3 will shift the oscillatory roller 1 away from the plate cylinder 4. This movement of the oscillatory roller 1 is opposed by its compression spring 32. As was discussed with respect to the first embodiment, the shifting of the oscillatory roller 1 with respect to the fixed side frames 7 is allowed by the gap S between the universal joint 17 and its encircling sleeve 11. This shifting of the joint 17 will move the axis of rotation 19 of the oscillatory roller out of alignment with the axis of rotation 21 of the drive gear ring 9. In the preferred embodiment, this clearance or gap S may be in the range of 5 mm. and is sufficient to allow the oscillatory roller 1 to be moved off the surface of the plate cylinder 4. The use of the universal joint 17 further allows the axis of rotation 19 of the oscillatory roller and the axis of rotation 21 of the drive gear ring 9 to stay in parallel alignment as the oscillatory roller 1 is moved off the surface of the plate cylinder 4.

In the two preferred embodiments depicted here, the oscillatory roller is the only one having the drive assembly of the present invention. It will be understood that this drive structure could also be provided to the ink forme rollers 2 and 3.

The inking system roller drive in accordance with the present invention allows the oscillatory ink roller 1 to be positively rotated and oscillated. In contrast with prior art arrangements, the oscillation and rotation of the oscillatory roller 1 is not dependent on a frictional drive. Further, in accordance with the present invention the inking system roller drive allows the oscillatory roller to be moved out of axial alignment with the drive gear when it is moved off the surface of the plate cylinder.

While preferred embodiments of an inking system roller drive in accordance with the present invention have been set forth fully and completely hereinabove, it will be apparent to one of skill in the art that a number of changes in, for example, the sizes of the rollers, the type of printing plates carried on the plate cylinder, the drive means for the drive gear and for the pivot drive and the like may be made without departing from the true spirit and scope of the present invention, which is accordingly to be limited only by the following claims.

What is claimed is:

1. An inking system roller drive in a rotary press, said inking system roller drive comprising:

an ink roller having an axis of rotation;

spaced pivoting frames supporting said ink roller for rotation about said axis of rotation and oscillation along said axis of rotation, said spaced pivoting frames being pivotably connected to side frames of the rotary press to allow shifting of said axis of rotation with respect to said side frames;

an ink roller drive shaft supported in said spaced pivoting frames and connected to said ink roller to rotate and oscillate said ink roller;

means for rotating and oscillating said ink roller drive shaft, said means for rotating and oscillating said ink roller drive shaft being supported by said side frames; and a universal joint coupling between said ink roller drive shaft and said means for rotating and oscillating said ink roller drive shaft whereby said spaced pivoting frames and said ink roller may be pivoted with respect to said means for rotating and oscillating said ink roller drive shaft.

2. The inking system roller drive in accordance with claim 1 wherein said universal joint coupling passes through a coaxially extending bushing supported in said side frames.

3. The inking system roller drive of claim 1 wherein said means for rotating said drive shaft includes a bushing, said ink roller bushing having a drive gear ring positioned on an outer side of said side frames.

4. The inking system roller drive of claim 3 further including a bore hole in said side frame, said bushing being rotatably and axially shiftably supported in said bore hole.

5. The inking system roller drive of claim 1 wherein said universal joint coupling has first and second universal joints.

6. The inking system roller drive of claim 1 wherein said spaced pivoting frames further support first and second spaced ink forme rollers which are shiftable with said spaced pivoting frames.

* * * * *